US005238322A

United States Patent [19]

Stirtz

[11] Patent Number: 5,238,322

[45] Date of Patent: Aug. 24, 1993

[54] BREAK-RESISTANT ROAD MARKER

[76] Inventor: Ronald H. Stirtz, 1660 Lorane Hwy., Eugene, Oreg. 97405

[21] Appl. No.: 797,045

[22] Filed: Nov. 25, 1991

[51] Int. Cl.[5] ..... E01F 9/00; E01F 9/01; E01F 9/04

[52] U.S. Cl. ..... 404/10

[58] Field of Search ..... 404/9-12, 404/14; 256/1, 13.1, DIG. 5

[56] References Cited

U.S. PATENT DOCUMENTS 4,122,795 10/1978 Doring ..... 404/10 X
4,245,922 1/1981 Auriemma ..... 404/10
4,298,292 11/1981 Sweeney ..... 404/10
4,445,803 5/1984 Dixon ..... 404/16
4,564,309 1/1986 Bjorlund ..... 404/10
4,571,118 2/1986 Schmanski ..... 404/10
4,621,940 11/1986 Anderson ..... 404/9 X

*Primary Examiner*—Ramon S. Britts
*Assistant Examiner*—Nancy P. Connolly
*Attorney, Agent, or Firm*—Kolisch, Hartwell, Dickinson, Hartwell & McCormack

[57] ABSTRACT

A marker formed of an elongate member of resilient and flexible material having two bends located between the ends of the member. One bend is relatively sharp, and extends to the rear of the marker, and the other bend is more gradual and extends upwardly in the marker. The marker in use has one end embedded in the ground, and the more gradual bend enables the marker to flatten out with a vehicle wheel driven over its marker. This reduces damage to the marker.

12 Claims, 1 Drawing Sheet 14
26
20
22
21
24
10b
56
62
66
10
50
52
10e
68
10c
10d
64
58
10a
12

10
14
40
10b
10b
50
52
30
10d
10e
10c
10a
12

56
50
58

10b
24
21
20
22
26
62
66
10e
64
68
10a

BREAK-RESISTANT ROAD MARKER

BACKGROUND AND SUMMARY OF THE INVENTION

This invention relates to markers, and more particularly to what are sometimes referred to as highway or road markers which are mounted in an upright position, ordinarily are white, and usually are reflectorized. The markers are mounted by embedding their lower ends in the ground, and are regularly seen along highways and roads delineating margins of a shoulder, or sometimes displaying information, such as mileage etc.

A problem characterizing markers, as presently known, is that when they are inadvertently run over by a vehicle, they tend to tear or break off at ground level. Even if the marker does not break or tear, a marker on being run over becomes permanently bent or deformed so as to impair its usefulness. Frequent replacement or repair of markers is reflected in higher highway maintenance costs.

A general object of this invention is to provide a new and improved marker featuring a construction which enables it to withstand being run over by a vehicle without being severely damaged.

A related object is to provide such a marker which is capable of being manufactured at a cost comparable to the cost of making conventional markers.

A further object is to provide a marker which includes a curved region located between the ends of the marker which flattens out without permanent rupturing or tearing of the marker when a vehicle wheel rolls over the marker.

Yet a further object is to provide a marker which has a pair of curved portions between its ends, one following the other, these having the effect of offsetting the top of the marker from the bottom of the marker. A step is formed by the first curved region, which becomes located, with the marker installed, at ground level. The second curved region enables bending over and flattening of the marker against the ground without rupture when a vehicle wheel moves thereover.

Yet another object is to provide an improved brace structure for a marker where the marker has a curved region between its ends. The brace structure spans the curved region to provide strength and lateral stability.

BRIEF DESCRIPTION OF THE DRAWINGS

These and other objects and advantages are attained by the invention, which is described hereinbelow in conjunction with the accompanying drawings, wherein.

DETAILED DESCRIPTION OF A PREFERRED EMBODIMENT

Figures 1, 2, 3, 4:
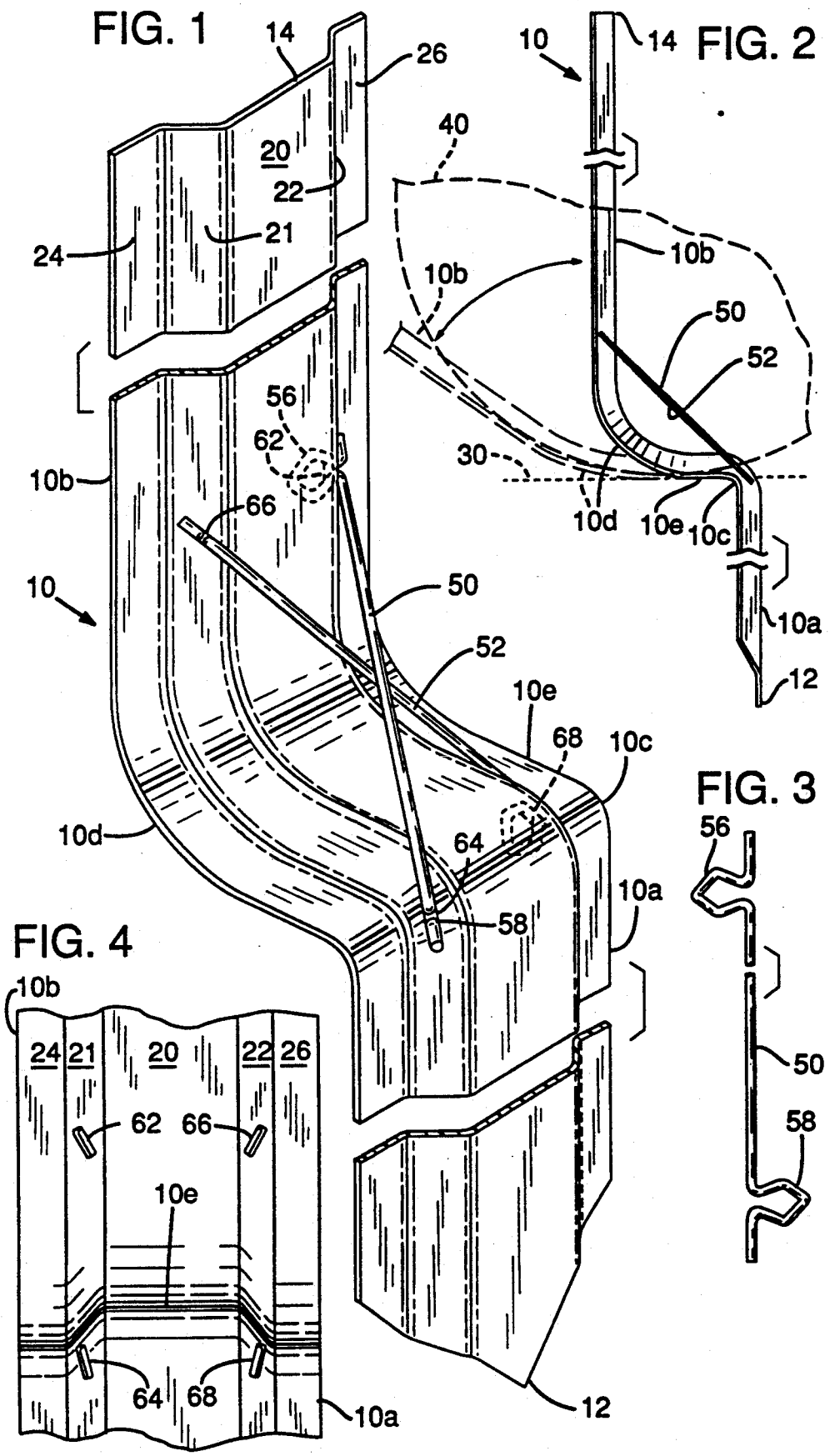
FIG. 1 is a perspective view, with portions broken away, illustrating a marker as contemplated herein.
FIG. 2 is a side elevational view, on a somewhat smaller scale, illustrating the marker embedded in the ground and showing how the marker deforms or bends when a vehicle wheel moves over the marker.
FIG. 3 is a view, with portions removed, illustrating a brace that may be incorporated with the marker.
FIG. 4 shows portions of a marker and slots provided therein such as may be used in anchoring ends of braces which are mounted on the marker to make it rigid.

Referring now to the drawings, the marker illustrated an elongate member 10 having a lower end shown at 12 and an upper end shown at 14. Member 10 may take the form of an elongate strip of material of a plastic or resin composition. The member may be made, for instance, of fiberglass, or of a thermoplastic, such as polyethylene. By the use of a thermoplastic material, field repairs of the marker are facilitated. For instance, a badly bent or deformed marker is repairable by heating the marker to a high enough temperature whereby the plastic of the marker becomes workable, and with the material as heated straightening the marker to restore its original shape.

The cross section of the strip of the material from which the marker is made has a nonlineal shape. In the particular embodiment of the marker illustrated, member 10 has approximately a shallow, channel-shaped cross section. Thus, the member includes a central web portion 20, inclined flange portions 21, 22 joined with outer margins of the central web portion, and terminal flange portions 24, 26 joined to outer margins of flange portions 21, 22. By providing member 10 with the nonlineal cross section, the marker is made stiffer and more resistent to bending in response to forces of low magnitude.

The marker member extends in a lower straight expanse or reach **10*a* which terminates in lower end 12. The lower end 12 may be pointed to facilitate insertion or embedding of the lower end in the ground. Member 10 further includes an elongate straight reach or expanse 10*b* forming the upper portion of member. This expanse terminates in upper end 14. As is apparent from viewing FIG. 2, expanses 10*a*, 10*b*** are laterally offset from each other, but ordinarily extend in substantially the same direction.

Joining expanses **10*a*, 10*b* is a curved region 10*c* which curves over a relatively small radius, and a curved region 10*d* which curves over a substantially larger radius. Regions 10*c* and 10*d* curve about axes extending transversely of elongate member 10. As the marker is described herein, the front side of the marker is the side that faces approaching traffic with the marker installed, this being the side which faces to the right in FIG. 2. Curved region 10*c* is a rearwardly curved region, progressing in a direction extending from the lower to the upper end of the marker, and curved region 10*d* is an upwardly curved region. The curvature of region 10*d*** is a concavity facing toward the front of the marker.

Between curved region **10*c* and curved region 10*d* is a transition region or bench region 10*e*. With the marker installed, and as illustrated in FIG. 2, the bottom of this bench region normally rests against the ground with the ground level in FIG. 2 being indicated at 30**. The bench region assists in anchoring the marker, in a proper position with external forces applied to the marker such as the result, for instance, of a vehicle wheel moving over the upper part of the marker. Further, the bench region provides a useful shape for holding the marker and pounding it as, for instance, when mounting the marker in the ground. Further, the bench region performs an indexing function in demarking the proper depth for embedding the lower end of the marker with the marker mounted.

During use of the marker, the marker is mounted as shown in FIG. 2 with its lower end embedded in the ground, bench region **10*e* at ground level and against the surface of the ground, and upper reach or extent 10*b*** extending upwardly to be clearly visible to vehicle traffic on the highway.

In most instances, when damage is done to a marker by a vehicle wheel, it is with movement of the vehicle toward the front side of the marker, or with the wheel moving from right to left with the marker illustrated as in FIG. 2. Assuming that this occurs, and as demonstrated by the portions of the vehicle wheel indicated at 40, as the vehicle wheel rolls over the upwardly protruding portions of the marker, the marker is deformed or flattened in the curved region of larger radius 10*d*. The upper part of the marker, in effect, is flattened out against the ground by the action of the vehicle wheel rolling thereover. The plastic composition selected for the marker imparts yieldable resilience to the upper part of the marker. On the vehicle wheel traveling beyond the marker, the upper extent of the marker springs back to its original position because of this resilience. Curved region 10*d*, with its curvature over a relatively large radius, accommodates this flattening action without tearing o breaking of the marker. This is to be compared to the sharp bending that occurs in a conventional straight marker which has to bend sharply at essentially right angles when a vehicle wheel rolls over it.

A marker may also be damaged by the action of a vehicle bumper striking the marker, with this being known as a bumper strike. With a bumper strike, curvature 10*d* tends to straighten out, but without the actual flattening produced by a vehicle wheel running over the marker. The inclusion of curvature 10*d* enables the marker to withstand bumper strikes without the bending and tearing that occurs with a conventional marker.

A marker may also be damaged by so-called angle strikes, where the vehicle engages the marker while moving at an angle toward and across the marker. With an angle strike, and because of the offset present of the upper reach of the marker with respect to the lower reach, a turning of portion 10*e* is possible which tends to cushion the destructive action of the strike on the marker.

The marker may include, in addition to member 10, brace structure as represented by the braces shown at 50, 52. The braces are included to increase the stability of the upper protruding portion of the marker with the marker in place.

Each brace may take the form of an elongate piece of material such as a plastic rod. The rod is shaped at spaced locations with reversely turned bend regions 56, 58. The plastic material of a rod is flexible and resilient, enabling a reversely turned portion when pinched to have its side-to-side dimension reduced.

Member 10 of the marker has slots provided therein such as those shown at 62, 64, 66, and 68. These are formed in flange portions 21, 22 which extend along either side of central web portion 20. A brace is installed by positioning it as shown in FIG. 1 with the brace angled across member 10 and having a reversely turned portion at one end fitting in a slot such as slot 62 and the reversely turned portion at the other end fitting in a slot on the other side of the marker. This fitting serves to anchor the ends of the brace on member 10. Two braces are usually installed as shown in FIG. 1, with these extending across each other.

By including the braces, repair of a damaged marker is facilitated. In most instances, a bent marker may be repaired merely by replacing the braces. With a more severely damaged marker, it may be desirable to apply heat and then bend the marker to return the marker to approximately its original shape. The braces may then be mounted in place. Because the braces have fixed lengths, with mounting of the braces, the marker is forced to assume a shape which is close to the original manufactured shape and with upper reach 10*b* extending vertically.

While modifications of the invention have been described herein, it should be obvious that other variations and modifications are possible without departing from the invention.

It is claimed and desired to secure by Letters Patent:

1. A marker adapted to have its lower end embedded in the ground comprising:

an elongate member having a lower end and an opposite end and a front side and an opposite rear side, said member progressing from its lower end extending initially as an elongate relatively straight expanse, said member between its ends having a concave curvature curving about an axis that extends transversely of the elongate member and said curvature facing the front side of the member and the member being resiliently deformable when a foreign object moves over the front side of the member to cause flattening of said concave curvature.

2. The marker of claim 1, wherein the member is an elongate strip of material and said strip has a nonlineal symmetrical cross section.

3. The marker of claim 2, wherein the strip of material has a channel-shaped cross section.

4. The mark of claim 1, wherein the member is composed of a thermoplastic plastic material.

5. The marker of claim 1, wherein said member progressing from its lower end extends initially as a straight reach and said member continues from said reach to join with said region of concave curvature.

6. A marker adapted to have its lower end embedded in the ground comprising:

an elongate member having a lower end and an upper end and front and rear sides, said member progressing from its lower end extending as a substantially straight lower reach, said member having a rearwardly curved portion at the upper end of said lower reach and a forwardly curved portion joining with said rearwardly curved portion, and said forwardly curved portion providing concave curvature facing the front side of the member, the member being resiliently deformable upon the wheel of a vehicle moving over the front side of the member to cause flattening of said concave curvature.

7. A road marker comprising:

an elongate member having a front side and a rear side and a lower end and an upper end and a lower straight reach terminating at said lower end and an upper straight reach terminating at said upper end and the reaches being offset but extending in essentially the same direction, said lower reach progressing upwardly joining with a rearwardly turned portion and said rearwardly turned portion progressing upwardly joining with an upwardly turned portion and said upwardly turned portion progressing upwardly joining with said upper reach, said rearwardly turned portion curving over approximately 90 degrees at a small radius and the upwardly turned portion curving over approximately 90 degrees at a substantially larger radius, said lower reach of said member being adapted for embedding in the ground with the rearwardly turned portion of the member at substantially ground level.

8. The marker of claim 7, wherein the member is a thermoplastic plastic material.

9. The marker of claim 7, which further includes means spanning the upwardly turned portion of the marker inhibiting flexing of the marker's upper reach with respect to the marker's lower reach.

10. The marker of claim 9, wherein the means spanning the upwardly turned portion comprises a detachable brace member with opposite ends detachably anchored to the marker.

11. A marker adapted to have its lower end embedded into the ground comprising:

an elongate member having a front and a rear and an upper end and a lower end and an upper straight reach terminating in said upper end and a lower straight reach terminating in said lower end, said upper and lower reaches extending in substantially the same direction but being laterally offset from each other and there being a region joining the upper and lower reaches of said member which is concavely curved in a direction facing the front of the marker, and means joining with said upper reach spanning said concavely curved region inhibiting flexing of the upper reach.

12. The apparatus of claim 11, wherein the elongate member is made of a flexible and resilient plastic material and the means joining with the upper reach comprises an elongate brace element having ends detachably anchored to the elongate member.

* * * * *